US007412824B1

(12) United States Patent
Newburry et al.

(10) Patent No.: US 7,412,824 B1
(45) Date of Patent: Aug. 19, 2008

(54) CATALYTIC CONVERTER SYSTEM FOR DIESEL ENGINES

(75) Inventors: Donald M. Newburry, Broken Arrow, OK (US); William B. Clary, Tulsa, OK (US)

(73) Assignee: Miratech Corporation, Tulsa, OK (US)

( * ) Notice: Subject to any disclaimer, the term of this patent is extended or adjusted under 35 U.S.C. 154(b) by 0 days.

(21) Appl. No.: 11/311,868

(22) Filed: Dec. 19, 2005

(51) Int. Cl.
*F01N 3/10* (2006.01)

(52) U.S. Cl. ..... 60/302; 60/313; 60/323; 60/324

(58) Field of Classification Search ..... 60/302, 60/322, 323, 324, 313
See application file for complete search history.

(56) References Cited

U.S. PATENT DOCUMENTS

| | | | | |
|---|---|---|---|---|
| 2,664,340 | A | 12/1953 | Houdry | |
| 3,644,098 | A * | 2/1972 | De Palma et al. | 422/176 |
| 3,968,645 | A * | 7/1976 | Noguchi et al. | 60/288 |
| 4,122,673 | A | 10/1978 | Leins | |
| 4,261,170 | A * | 4/1981 | Suzuki | 60/302 |
| 4,969,329 | A | 11/1990 | Bolton et al. | |
| 4,969,330 | A | 11/1990 | Groff et al. | |
| D351,608 | S | 10/1994 | Cox | |
| 5,709,081 | A | 1/1998 | Bruestle | |
| 6,422,008 | B2 | 7/2002 | Voss et al. | |
| 6,622,481 | B1 * | 9/2003 | Ruman et al. | 60/298 |
| 6,725,653 | B2 | 4/2004 | Brown et al. | |
| 6,820,417 | B2 | 11/2004 | May et al. | |
| 7,028,468 | B2 * | 4/2006 | Brown et al. | 60/299 |
| 2004/0040287 | A1 | 3/2004 | Beutel et al. | |
| 2005/0042151 | A1 | 2/2005 | Alward et al. | |

OTHER PUBLICATIONS

Tumola, Heikki, et al., *A New Metallic Catalyst*, Advanced Catalysts and Substrates (SP-1675), SAE A Technical Paper Series 2002-01-0357, SAE The Engineering Society for Advancing Mobility Land Sea Air and Space International, SAE 2002 World Congress, Detroit, Michigan Mar. 4-7, 2002.

* cited by examiner

*Primary Examiner*—Thomas Denion
*Assistant Examiner*—Diem Tran
(74) *Attorney, Agent, or Firm*—Fellers, Snider, Blankenship, Bailey & Tippens, P.C.; Dennis D. Brown

(57) ABSTRACT

An improved exhaust system for a diesel engine and an improved overhead exhaust manifold segment therefore wherein the improvement comprises a plurality of catalytic converter elements removably positionable in the overhead exhaust manifold over the outlet ends of a series of exhaust port legs extending upwardly to the bottom of the overhead exhaust manifold from the cylinder exhaust ports.

13 Claims, 3 Drawing Sheets

CATALYTIC CONVERTER SYSTEM FOR DIESEL ENGINES

FIELD OF THE INVENTION

The present invention relates to catalytic converters for diesel engines having overhead exhaust manifold systems.

BACKGROUND OF THE INVENTION

Two-stroke and four stroke medium speed diesel engines such as those manufactured by Electromotive Diesels (EMD) of LaGrange, Ill. (formerly a division of General Motors) are used in locomotives, in power generating systems, and in marine propulsion applications. An example of one common type of diesel engine, depicted in FIG. 1, is an EMD 645 E-16 two-stroke, "roots-blown" engine having an exhaust system which comprises an elongated overhead exhaust manifold 4 which runs horizontally above the centerline of the engine 2. The overhead manifold 4 receives exhaust gas via a series of pairs of opposing manifold legs 6 which extend upwardly to the bottom of the horizontal exhaust manifold 4 from the individual cylinder exhaust ports of the engine 2. The exhaust from the vertical manifold legs 6 collects in the horizontal exhaust manifold 4 and flows out of the exhaust manifold 4 via one or more (typically a plurality of) exhaust stacks 3.

As is also known in the art, another common type of diesel engine is a turbocharged engine which is similar to the roots-blown engine 2 depicted in FIG. 1 except that the exhaust collected in the horizontal overhead exhaust manifold of the turbocharged engine flows from one of the longitudinal ends of the horizontal overhead exhaust manifold to a turbocharger.

Turbocharged and roots-blown diesel engines typically have either 8, 12 or 16 cylinders arranged in a V configuration. Consequently, the manifold legs 6 of the exhaust system extend upwardly from the cylinder ports to the overhead exhaust manifold 4 in a series of four, six or eight opposing pairs. The overhead exhaust manifold 4 is typically formed of a series of manifold sections 10 such that two opposing pairs of the manifold legs 6 are connected to each manifold section 10. Each manifold section 10 also typically includes a flange 12 on one or both of the longitudinal ends thereof for bolting to flanged expansion joints positioned between the other manifold sections 10.

A need presently exists for an effective catalytic converter system for treating the exhaust gas from diesel engines. The application of catalytic converter devices to the exhaust systems of two-stroke and four-stroke diesel engines has been difficult for several reasons. In many cases, particularly in locomotive applications, there is not sufficient space around the engine for installation of a catalytic converter system. In addition, the temperature of the exhaust from two-stoke and four-stroke engines is relatively low in terms of the temperature necessary to "light-off" the catalyst to initiate and maintain the conversion reaction. Further, these engines have a relatively high lube oil consumption rate. In addition, it is difficult in locomotive and other applications to remove the exhaust manifolds from the engines due to a lack of sufficient overhead space for the lifting equipment. Also, the back pressure limits of the turbocharged diesel engines are typically very low.

SUMMARY OF THE INVENTION

The present invention satisfies the needs and alleviates the problems mentioned above. In one aspect, there is provided an improved exhaust system for a diesel engine wherein the exhaust system includes a series of pairs of upwardly extending exhaust port legs having upper outlet ends for delivering exhaust into an overhead exhaust manifold extending substantially horizontally over the diesel engine. The improvement comprises a plurality of catalytic converter elements removably positionable in the overhead exhaust manifold over the upper outlet ends of the exhaust port legs.

In another aspect, the improvement to the exhaust system preferably comprises a separate one of the catalytic converter elements being removably positionable in the overhead exhaust manifold over each of the upper outlet ends of the exhaust port legs. Further, the improvement preferably comprises the catalytic converter elements being removably positionable in the overhead exhaust manifold in opposing pairs, each of the opposing pairs of the catalytic converter elements forming a lateral V arrangement.

In another aspect, there is provided an improved overhead exhaust manifold segment for a diesel engine wherein the exhaust manifold segment has a longitudinal interior passage, a longitudinal wall surrounding the longitudinal interior passage, and a plurality of openings in a lower portion of the longitudinal wall for receiving an engine exhaust. The improvement comprises one or more catalytic converter elements removably insertable in the overhead exhaust manifold segment in a manner effective such that the engine exhaust will flow through the one or more catalytic converter elements into an upper longitudinal portion of the interior passage.

In another aspect, the improvement to the overhead exhaust manifold segment preferably further comprises four of the catalytic converter elements being insertable in the overhead exhaust manifold segment in two opposing pairs. In addition, the improvement preferably comprises the four catalytic converter elements being insertable in the overhead exhaust manifold segment in a manner such that each of the opposing pairs forms a lateral V arrangement.

Further aspects, features, and advantages of the present invention will be apparent to those in the art upon examining the accompanying drawings and upon reading the following detailed description of the preferred embodiments.

DETAILED DESCRIPTION OF THE PREFERRED EMBODIMENTS

Figure 1:
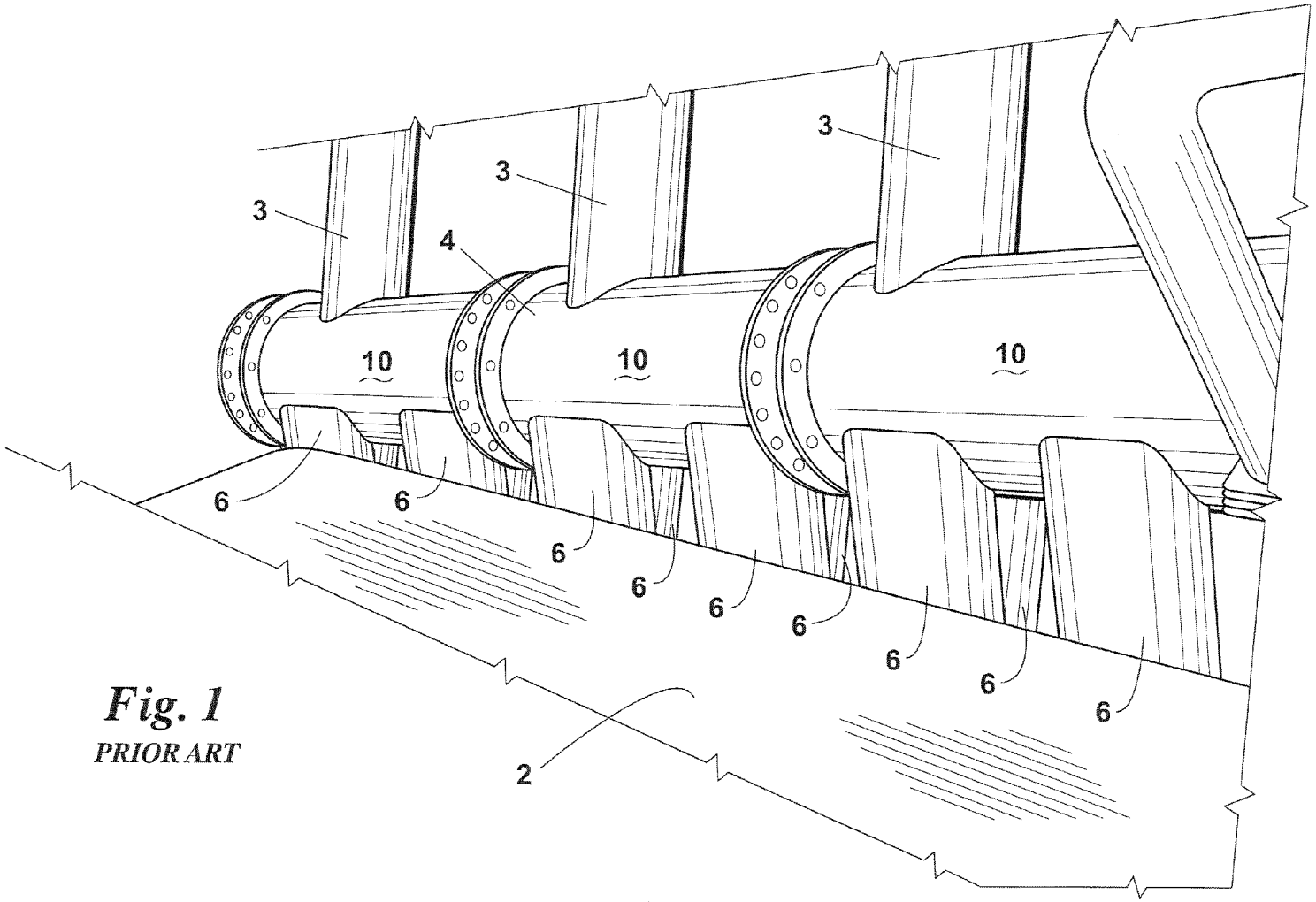
Fig. 1 PRIOR ART
FIG. 1 is a perspective view of a prior art overhead exhaust system of an Electromotive Diesels (EMD) roots-blown, two-stroke diesel engine 2.
Figure 2:
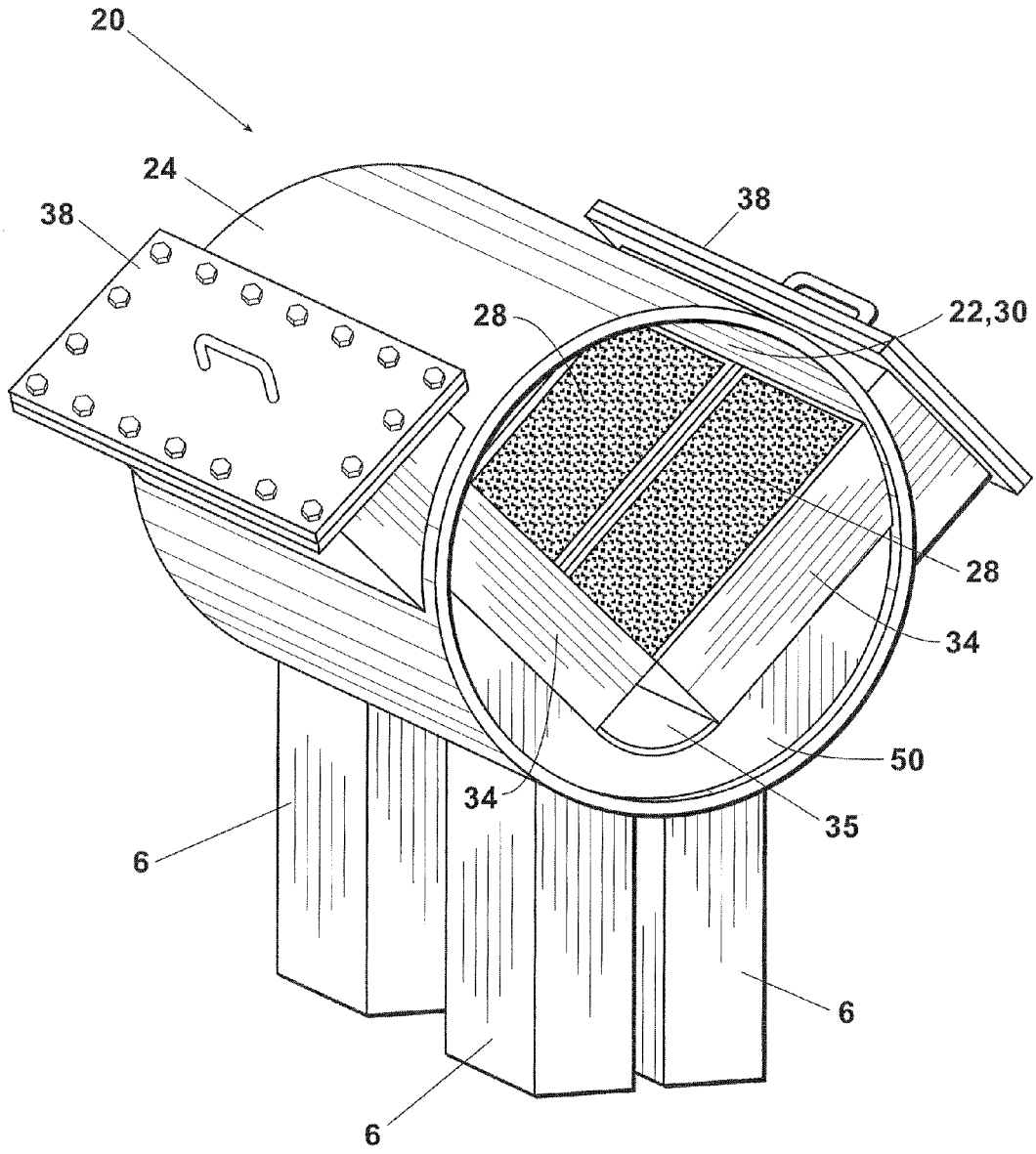
FIG. 2 is a partially cutaway perspective view of an inventive, improved exhaust manifold segment 20 which improves and replaces the manifold segments 10 of the prior art overhead exhaust manifold 4 shown in FIG. 1.
Figure 3:
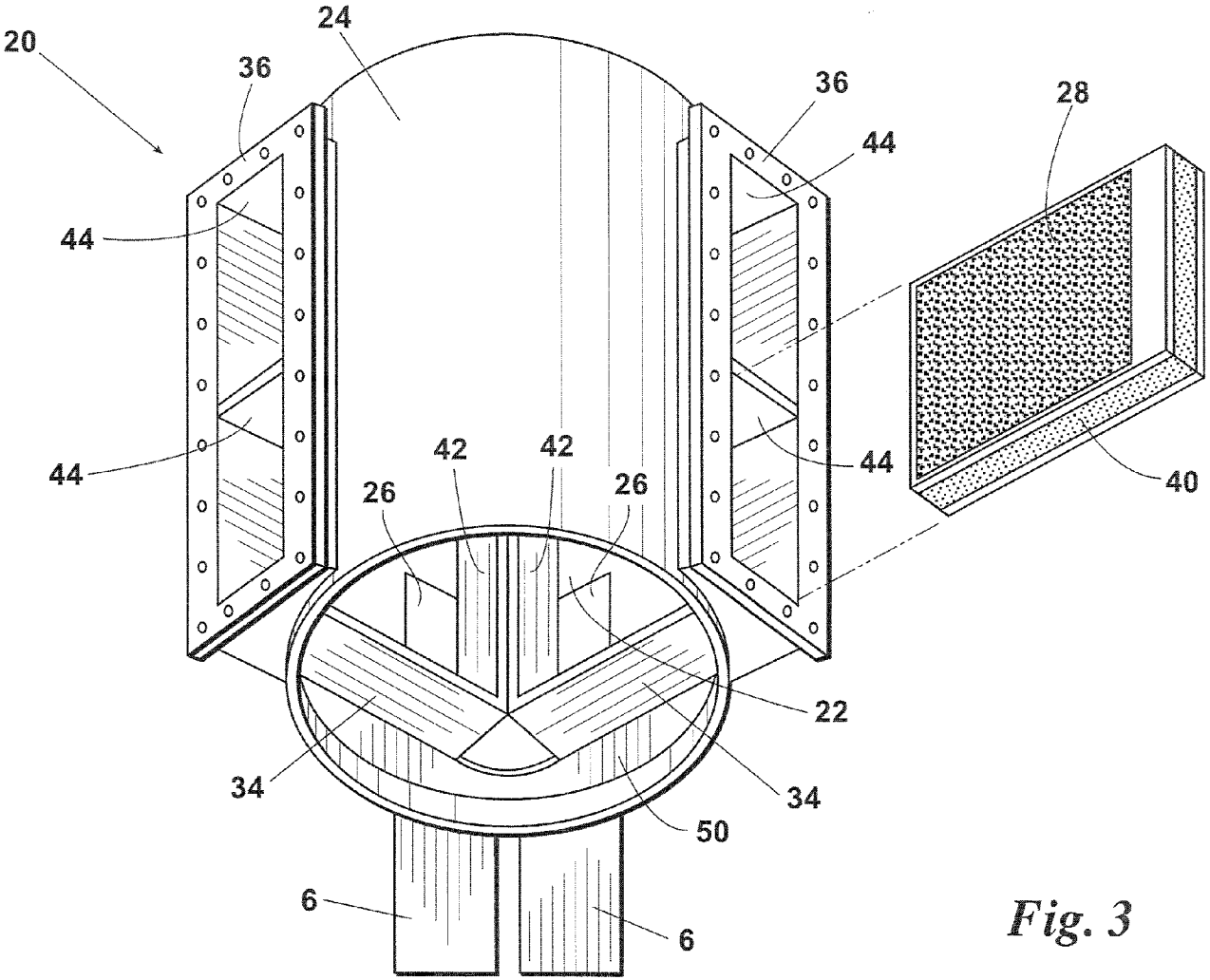
FIG. 3 is a top, partially cutaway perspective view of the inventive improved overhead manifold segment 20.

An embodiment 20 of an improved overhead exhaust manifold segment for a diesel engine exhaust system is depicted in FIGS. 2 and 3. The inventive manifold segment 20 improves and replaces the overhead manifold segments 10 presently used in the overhead exhaust systems of roots-blown, turbocharged, or other types of diesel engines.

The inventive manifold segment 20 comprises: a longitudinal interior passage 22; a longitudinal outer cylindrical wall 24 which surrounds the internal passage 22; a plurality of (preferably at least two and most preferably four) openings 26 in the bottom of the cylindrical wall 24 which are in fluid communication with the upper outlet ends of the manifold legs 6 extending from the engine cylinder exhaust ports; and one or more (preferably a plurality of) catalytic converter elements 28 which are removably insertable in the longitudinal passage 22 such that substantially all of the engine exhaust gas received in the overhead exhaust manifold via the vertical manifold legs 6 will flow through the catalytic converter element(s) 28 into an upper longitudinal portion 30 of the longitudinal interior passage 22.

The catalytic converter element(s) 28 will preferably comprise a diesel oxidation catalyst on a metal foil substrate. The substrate will preferably be constructed of layers of corrugated foil with angled channels which are spot welded together. Catalysts and catalyst substrates of this type are known in the art and are available, for example, from EcoCat Oy. Such catalysts and catalyst substrates are also described, for example, in Heikki Tuomola, et al., "A New Metallic Catalyst", SAE Technical Paper Series, 2002.

The inventive manifold segment 20 preferably further comprises one or more track slots 34 or other types of slots which extend into the longitudinal interior passage 22 for removably receiving and holding the catalytic converter elements 28. The elements 28 can be any desired shape but are preferably rectangular and the slots 34 preferably have a corresponding U-shape. Flanged openings 36 are provided through the manifold segment wall 24 at the outer ends of the slots 34 for receiving and removing the catalytic converter elements 28. Covers 38 are removably attachable to the flanged openings 36 using bolts or other suitable attachments for closing the flanged openings 36. A sealing gasket 40 is preferably attached around the perimeter of each of the catalytic converter elements 28 for sealing against the bottom and side walls 42 and 44 of the U-shaped slots 34 and for sealing against the inner surfaces of the covers 38.

The inventive manifold segment 20 can use a single catalytic element 28, a series of at least two catalytic elements 28, or one or more pairs of opposing catalytic elements 28. If a single element 28 or a series of single elements 28 is/are used, each element will preferably be inserted laterally in a substantially horizontal orientation. If one of more pairs of opposing elements 28 are used, each pair will preferably be inserted in an upright V arrangement as illustrated in FIGS. 2 and 3. In addition, rather than having pairs of openings 26 in the bottom thereof wherein each individual opening 26 receives exhaust from a separate engine cylinder, the inventive manifold segment can alternatively have a smaller number of larger openings 26 such that at least some of the openings 26 receive exhaust from more than one engine cylinder.

Although generally any number of catalytic converter elements 28 could be used in the inventive manifold segment 20, the inventive manifold segment 20 most preferably includes two pairs of opposing slots 34 which hold a total of four catalytic converter elements 28. The inventive manifold segment 20 thus most preferably provides separate catalytic converter elements 28 positioned over each of the exhaust gas openings 26 in the bottom of the manifold segment 20. Additionally, each opposing pair of slots 34 and the corresponding pair of catalytic converter elements 28 positioned therein preferably form an upright V arrangement as illustrated in FIGS. 2 and 3.

Although cut away to some extent in FIGS. 2 and 3 to allow better viewing of the internal components of the inventive manifold segment 20, a partial wall 50 is preferably provided at each end of the inventive manifold segment 20 for completely closing off the area beneath the slots 34, including the ends of the resulting inverted V channel 35 formed beneath the abutting inner ends of the slots 34. The walls 50 thus ensure that substantially all of the exhaust gas flowing into the bottom of manifold segment 20 from the vertical manifold legs 6 travels through the catalytic converter elements 28 and collects in the open, upper longitudinal portion 30 of the manifold. The exhaust gas received in the upper longitudinal portion 30 then continues to flow in the normal manner to a turbocharger or to an exhaust stack, or is otherwise discharged.

As will thus be apparent, the inventive system provides convenient access to the catalytic elements 28 for removal, inspection, cleaning, and/or replacement without requiring that the overhead manifold or the overhead manifold segments 20 be removed. The preferred V arrangement of the catalytic elements 28 further provides a large catalyst flow area which minimizes pressure drop through the inventive system. Further, the catalytic converter elements 28 are located in close proximity to the exhaust ports of the engine so that the temperature of the exhaust as it passes through the catalytic converter elements 28 is maximized in order to improve the operation and efficiency of the converter catalyst.

Thus, the present invention is well adapted to carry out the objectives and attain the ends and advantages mentioned above as well as those inherent therein. While presently preferred embodiments have been described for purposes of this disclosure, numerous changes and modifications will be apparent to those in the art. Such changes and modifications are encompassed within the spirit of this invention as defined by the appended claims.

What is claimed is:

1. In an exhaust system for a diesel engine including a series of pairs of upwardly extending exhaust port legs having upper outlet ends for delivering exhaust into an overhead exhaust manifold extending substantially horizontally over said diesel engine, said overhead exhaust manifold having a longitudinal interior passage and a longitudinally extending outer wall surrounding said interior passage, the improvement comprising:

a plurality of catalytic converter elements removably insertable through insert openings in said longitudinally extending outer wall into said overhead exhaust manifold such that said catalytic converter elements are positioned over said upper outlet ends of said exhaust port legs;

said insert openings being in opposing pairs on opposite sides of said longitudinally extending outer wall;

said catalytic converter elements being removably insertable in said overhead exhaust manifold through said insert openings in opposing pairs such that each of said opposing pairs of said catalytic converter elements forms a lateral upright V arrangement in said longitudinal interior passage; and each of said catalytic converter elements comprising a diesel oxidation catalyst on a substrate comprising a corrugated metal foil.

2. The exhaust system of claim 1 wherein the improvement further comprises a separate one of said catalytic converter elements being removably insertable in said overhead exhaust manifold over each of said upper outlet ends of said exhaust port legs.

3. The exhaust system of claim 1 wherein the improvement further comprises said catalytic converter elements being removably insertable in said overhead exhaust manifold such that substantially all of said exhaust delivered from said upper outlet ends of said exhaust port legs will flow through said catalytic converter elements into an upper longitudinal portion of said longitudinal interior passage.

4. The exhaust system of claim 1 wherein the improvement further comprises said opposing pairs of said catalytic converter elements being receivable in opposing pairs of element holding slots extending into said longitudinal interior passage of said overhead exhaust manifold in a lateral upright V arrangement.

5. The exhaust system of claim 1 wherein said overhead exhaust manifold comprises a plurality of sections assembled in series, each of said sections having two of said pairs of upwardly extending exhaust port legs connected thereto and wherein said improvement further comprises two opposing pairs of said catalytic elements being removably insertable in each of said sections.

6. The exhaust system of claim 1 wherein the improvement further comprises said substrate comprising a plurality of layers of said corrugated metal foil.

7. The exhaust system of claim 1 wherein the improvement further comprises:

each of said element holding slots having an outer end;

said overhead exhaust manifold having said insert openings at said outer ends of said element holding slots, said catalytic converter elements being removably receivable through said insert openings; and removable covers for closing said insert openings.

8. The exhaust system of claim 7 wherein the improvement further comprises each of said catalytic converter elements having an outer perimeter and a sealing gasket attached around said outer perimeter such that each of said catalytic converter elements is completely surrounded by one of said sealing gaskets and said sealing gaskets are effective for sealing between said catalytic converter elements and said element holding slots and between said catalytic converter elements and said covers.

9. In an overhead exhaust manifold segment for a diesel engine having a longitudinal interior passage, a longitudinal wall surrounding said longitudinal interior passage, and a plurality of openings in a lower portion of said longitudinal wall for receiving an engine exhaust, the improvement comprising:

four catalytic converter elements removably insertable in said overhead exhaust manifold segment through insert openings in said longitudinal wall in a manner effective such that said engine exhaust will flow through said catalytic converter elements into an upper longitudinal portion of said interior passage;

said insert openings being in at least one opposing pair on opposite sides of said longitudinally extending outer wall;

said catalytic converter elements being removably insertable in two opposing pairs in said overhead exhaust manifold segment through said insert openings;

each of said opposing pairs of said catalytic converter elements forming a lateral upright V arrangement in said interior passage; and each of said catalytic converter elements comprising a diesel oxidation catalyst on a substrate comprising a corrugated metal foil.

10. The overhead exhaust manifold segment of claim 9 wherein the improvement further comprises each of said opposing pairs of said catalytic converter elements being insertable in an opposing pair of element holding slots extending into said longitudinal interior passage in a lateral upright V arrangement.

11. The overhead exhaust manifold segment of claim 9 wherein the improvement further comprises said substrate comprising a plurality of layers of said corrugated metal foil.

12. The overhead exhaust manifold segment of claim 10 wherein the improvement further comprises:

said element holding slots having outer ends;

said longitudinal wall having said insert openings therethrough at said outer ends for inserting said catalytic converter elements into said element holding slots; and removable covers for closing said insert openings.

13. The overhead exhaust manifold segment of claim 12 wherein the improvement further comprises each of said catalytic converter elements having an outer perimeter and a sealing gasket attached around said outer perimeter such that each of said catalytic converter elements is completely surrounded by one of said sealing gaskets and said sealing gaskets are effective for sealing between said catalytic converter elements and said element holding slots and between said catalytic converter elements and said covers.

* * * * *